US007918965B2

(12) United States Patent
Leduc et al.

(10) Patent No.: US 7,918,965 B2
(45) Date of Patent: Apr. 5, 2011

(54) METHOD FOR THE PRODUCTION OF PAPER, CARDBOARD AND CARD

(75) Inventors: Marc Leduc, Mannheim (DE); Oliver Koch, Eppelheim (DE); Simon Champ, Ludwigshafen (DE); Rainer Blum, Mannheim (DE); Andreas Merkel, Bad Duerkheim (DE); Knut Menke, Roemerberg (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 445 days.

(21) Appl. No.: 12/065,688

(22) PCT Filed: Sep. 5, 2006

(86) PCT No.: PCT/EP2006/066019

§ 371 (c)(1),
(2), (4) Date: Mar. 4, 2008

(87) PCT Pub. No.: WO2007/031442

PCT Pub. Date: Mar. 22, 2007

(65) Prior Publication Data

US 2008/0196852 A1 Aug. 21, 2008

(30) Foreign Application Priority Data

Sep. 13, 2005 (DE) ..... 10 2005 043 800

(51) Int. Cl.
*D21H 21/10* (2006.01)

(52) U.S. Cl. ..... 162/168.1; 162/168.2; 162/168.3; 162/181.6; 162/181.8; 162/183

(58) Field of Classification Search ..... 162/164.1, 162/164.6, 168.1, 168.2–168.7, 183; 210/727, 210/728, 734–736
See application file for complete search history.

(56) References Cited

U.S. PATENT DOCUMENTS

| | | | | |
|---|---|---|---|---|
| 5,473,033 | A * | 12/1995 | Kuo et al. | 526/307 |
| 6,103,065 | A | 8/2000 | Humphreys et al. | |
| 6,132,558 | A | 10/2000 | Dyllick-Brenzinger et al. | |
| 6,273,998 | B1 * | 8/2001 | Kuo et al. | 162/168.2 |
| 6,524,439 | B2 * | 2/2003 | Chen et al. | 162/168.1 |
| 7,306,701 | B2 | 12/2007 | Blum et al. | |
| 2002/0166648 | A1 | 11/2002 | Frolich et al. | |
| 2003/0136534 | A1 | 7/2003 | Johansson-Vestin et al. | |
| 2003/0192664 | A1 * | 10/2003 | Kulick et al. | 162/164.1 |
| 2009/0050282 | A1 * | 2/2009 | Faucher et al. | 162/164.5 |

FOREIGN PATENT DOCUMENTS

| | | | |
|---|---|---|---|
| DE | 196 27 553 | A1 | 1/1998 |
| EP | 0 462 365 | A1 | 12/1991 |
| FR | 2 869 625 | | 11/2005 |
| WO | WO 98/29604 | | 7/1998 |
| WO | WO 01/34908 | A1 | 5/2001 |
| WO | WO 01/34909 | A1 | 5/2001 |
| WO | WO 02/33171 | A1 | 4/2002 |
| WO | WO 2004/015200 | A1 | 2/2004 |
| WO | WO 2005/116336 | A1 | 12/2005 |

* cited by examiner

*Primary Examiner* — Eric Hug
*Assistant Examiner* — Peter Chin
(74) *Attorney, Agent, or Firm* — Oblon, Spivak, McClelland, Maier & Neustadt, L.L.P.

(57) ABSTRACT

Process for the production of paper, board and cardboard by draining a paper stock with sheet formation in the presence of a retention aid system comprising (i) at least one polymer comprising vinylamine units, in the form of the free bases, of the salts and/or in quaternized form, as the sole cationic polymer, (ii) at least one linear, anionic polymer having a molar mass $M_w$ of at least 1 million and/or at least one branched, anionic, water-soluble polymer and/or bentonite and/or silica gel and (iii) at least one particulate, anionic, crosslinked, organic polymer having a mean particle diameter of at least 1 μm and an intrinsic viscosity of less than 3 dl/g, and use of the retention aid system comprising the components (i), (ii) and (iii) as an additive in the production of paper, board and cardboard.

9 Claims, No Drawings

METHOD FOR THE PRODUCTION OF PAPER, CARDBOARD AND CARD

DESCRIPTION

The invention relates to a process for the production of paper, board and cardboard by draining a paper stock in the presence of at least one polymer comprising vinylamine units and at least one particulate, anionic, crosslinked, organic polymer.

EP-A-0 462 365 discloses a process for the production of paper, high molecular weight cationic polymers together with particulate, anionic, crosslinked or uncrosslinked, organic polymers and, if appropriate, additionally bentonite or finely divided silica being used as the retention aid. The crosslinked organic polymers have a particle size of less than 750 nm.

US-A-2003/0192664 likewise discloses a process for the production of paper, (i) a particulate, ionic, organic, crosslinked polymer having a particle diameter of less than 500 nm and (ii) a polymer comprising vinylamine units being metered into an aqueous fiber suspension.

In the process disclosed in WO-A-98/29604 and intended for the production of paper, a water-soluble, cationic, polymeric flocculent is first metered into a paper stock, resulting in the formation of cellulose flocs which are then mechanically disintegrated and treated with a water-soluble anionic, branched, polymeric retention aid which has an intrinsic viscosity of more than 3 dl/g and a tan delta value of at least 0.5 at 0.005 Hz. The paper stock is then drained on a wire with sheet formation.

Similar processes for the production of paper are disclosed in WO-A-01/34908 and WO-A-01/34909. However, the drainage of the paper stock can also be carried out in the absence of a water-soluble, cationic polymeric flocculent. The anionic branched, polymeric retention aid has an intrinsic viscosity of more than 1.5 dl/g. However, it is always used in combination with clay or silica (siliceous material) as a flocculent system.

WO-A-02/33171 discloses a process for the production of paper, a paper stock being treated with a flocculent system which consists of silica gel (siliceous material) and organic microparticles having a particle diameter of less than 750 nm in the non-swollen state. The microparticles are crosslinked. They have a solution viscosity of at least 1.1 mPa·s and a content of crosslinking agent, incorporated in the form of polymerized units, of more than 4 mol ppm, based on the monomer units.

According to the teaching of the prior French application 04/04582, a retention aid system which consists of (i) at least one cationic polymer, (ii) at least one silicate, such as silica gel or bentonite, and/or an anionic or amphoteric organic polymer and (iii) at least one particulate, crosslinked, anionic polymer having a particle size of at least 1 μm and an intrinsic viscosity of less than 3 dl/g is used for the production of paper and paper products. In a preferred embodiment, a fixing agent, such as polyaluminum chloride, polydiallyldimethylammonium chloride, polymers comprising vinylamine units or dicyandiamide resins, is metered before the addition of the cationic polymer.

It is the object of the invention to provide a further process for the production of paper.

The object is achieved, according to the invention, by a process for the production of paper, board and cardboard by draining a paper stock with sheet formation in the presence of a retention aid system comprising at least one polymer comprising vinylamine units and at least one particulate, anionic, crosslinked, organic polymer, if (i) at least one polymer comprising vinylamine units, in the form of the free bases, of the salts and/or in quaternized form, as the sole cationic polymer, (ii) at least one linear, anionic polymer having a molar mass $M_w$ of at least 1 million and/or at least one branched, anionic, water-soluble polymer and/or bentonite and/or silica gel, and (iii) at least one particulate, anionic, crosslinked, organic polymer having a mean particle diameter of at least 1 μm and an intrinsic viscosity of less than 3 dl/g are used as the retention aid system.

The component (ii) of the retention aid system may comprise either only the linear, anionic polymer or bentonite and/or silica gel or both components, which, however, are then metered separately or as a mixture to the paper stock. However, it is also possible to use, as component (ii), at least one branched, anionic, water-soluble polymer and/or bentonite and/or silica gel or a linear, anionic polymer and a branched, anionic, water-soluble polymer. The components (ii) and (iii) of the retention aid system can also in each case be added separately or as a mixture to the paper stock.

In a preferred embodiment of the invention, the retention aid system comprises (i) at least one polymer comprising vinylamine units, in the form of the free bases or of the salts, which is obtainable by hydrolysis of polymers comprising vinylformamide units, the degree of hydrolysis being from 0.5 to 100 mol %, (ii) at least one linear, anionic polymer having a molar mass of at least 2 million, obtained from (a) acrylamide and/or methacrylamide and (b) acrylic acid, methacrylic acid, maleic anhydride, maleic acid, itaconic acid, crotonic acid, 2-acrylamido-2-methylpropanesulfonic acid, vinylsulfonic acid and/or salts of said acids and/or bentonite and/or silica gel and (iii) at least one particulate, anionic, crosslinked organic polymer which comprises, incorporated in the form of polymerized units, at least one ethylenically unsaturated $C_3$- to $C_5$-carboxylic acid, an ethylenically unsaturated sulfonic acid or a salt of said acids and in each case at least one crosslinking agent and which can be prepared by inverse emulsion polymerization.

Polymers (i) comprising vinylamine units are known. They are usually prepared from homo- or copolymers of N-vinylformamide by hydrolysis of the formyl groups from the vinylformamide units present in the respective polymers with formation of vinylamine units. The hydrolysis of the formyl groups can be carried out with acids or bases as well as enzymatically. Polymers comprising vinylamine units are described, for example, in U.S. Pat. No. 4,421,602, U.S. Pat. No. 5,334,287, EP-A-0 216 387, U.S. Pat. No. 5,981,689, WO-A-00/63295, U.S. Pat. No. 6,121,409 and in US-A-2003/0192664 mentioned for the prior art. For example from 5 to 100 mol %, preferably from 15 to 98 and in particular from 20 to 95 mol % of the vinylformamide units present in the homo- or copolymers are hydrolyzed.

Of particular technical interest are polyvinylamines which are obtainable by hydrolysis of poly-N-vinylformamides. The molar mass $M_w$ of the polymers comprising vinylamine units is, for example, from 10,000 to 15 million, generally from 30,000 to 5 million and in particular from 1 million to 5 million.

In an embodiment of the invention, a mixture of (a) a polymer comprising vinylamine units and having a molar mass of from 10,000 to 500,000, preferably from 45,000 to 350,000, and (b) a polymer comprising vinylamine units and having a molar mass of at least 1 million is used as component (i) of the retention aid system. The weight ratio (a):(b) may be varied within a wide range, for example from 90:10 to 10:90. In general, it is in the range from 60:40 to 40:60.

The polymers comprising vinylamine units can be used in any form, for example in the form of the free bases. The polyvinylamines are present in this form if the hydrolysis of the poly-N-vinylformamide was carried out with the aid of bases, such as sodium hydroxide solution or potassium hydroxide solution. If acids, such as hydrochloric acid, sulfuric acid or phosphoric acid, are used in the hydrolysis of polymers comprising N-vinylformamide units, the corresponding salts of the acids form. However, the polymers comprising vinylamine units may also be used in quaternized form; for example, polymers comprising vinylamine units can be quaternized with methyl chloride, dimethyl sulfate, ethyl chloride or benzyl chloride.

The polymers comprising vinylamine units are used, for example, in an amount of from 0.003 to 0.3% by weight, based on dry paper stock. These polymers are used as sole cationic retention aids.

The component (ii) of the retention aid system comprises at least one linear, anionic polymer having a molar mass of at least 1 million and/or at least one branched, anionic, water-soluble polymer and/or bentonite and/or silica gel. Preferably used linear polymers have a molar mass $M_w$ of at least 2 million, in general from 2.5 to 20 million. They are prepared, for example, by polymerization of (a) acrylamide and/or methacrylamide and (b) acrylic acid, methacrylic acid, maleic anhydride, maleic acid, itaconic acid, crotonic acid, 2-acrylamido-2-methylpropanesulfonic acid, vinylsulfonic acid and/or the salts of said acids. Preferably used anionic polymers of component (ii) are copolymers of acrylamide and acrylic acid or sodium acrylate, copolymers of acrylamide and methacrylic acid, copolymers of acrylamide and sodium vinylsulfonate and copolymers of acrylamide and 2-acrylamido-2-methylpropanesulfonic acid. The proportion of the anionic monomers in the copolymer may be, for example, from 5 to 95 mol %.

Branched, anionic, water-soluble polymers are known, cf. WO-A-98/29604, EP-B-1 167 392 and EP-A-0 374 458. They have an intrinsic viscosity of more than 3 dl/g. They are obtainable, for example, by reverse suspension polymerization of anionic monomers, such as acrylic acid, methacrylic acid, vinylsulfonic acid and/or salts thereof in the presence of at least one crosslinking agent in an amount of less than 6 mol ppm, based on the monomers used, if polymerization is effected in the absence of a regulator. If the polymerization of the anionic monomers is carried out in the presence of at least one regulator, it is possible—as is evident from the above-mentioned references—for the polymerization of the anionic monomers to be carried out in the presence of from 6 to 25 mol ppm of at least one crosslinking agent. It is known that crosslinking agents are compounds which comprise at least two ethylenically unsaturated double bonds in the molecule, such as methylenebisacrylamide, pentaerythrityl triacrylate or glycol diacrylate.

The linear, anionic polymer and/or the branched, anionic, water-soluble polymer of component (ii) are used, for example, in an amount of from 0.003 to 0.3% by weight, based on dry paper stock.

The component (ii) can, if appropriate, comprise bentonite and/or silica gel in addition to a linear and/or a branched anionic polymer. In the context of the invention, bentonite is to be understood as meaning finely divided minerals which are swellable in water, e.g. bentonite itself, hectorite, attapulgite, montmorillonite, nontronite, saponite, sauconite, hormite and sepiolite. For example, modified and unmodified silicas are suitable as silica gel. Bentonite and/or silica gel are usually used in the form of an aqueous suspension. If bentonite and/or silica gel are used in the process according to the invention, the amount is from 0.01 to 1.0, preferably from 0.1 to 0.5% by weight, based on dry paper stock.

The retention aid system comprises, as component (iii), particulate, anionic, crosslinked, organic polymers having a mean particle diameter of at least 1 μm and an intrinsic viscosity of less than 3 dl/g. These are, for example, known aqueous polymer dispersions, water-in-oil polymer dispersions or so-called water-in-water polymer dispersions, which either have a high neutral salt concentration or are stabilized with protective colloids. The mean particle diameter of the crosslinked anionic polymer particles is, for example, in the range from 1 to 20 μm, preferably from 1 to 10 μm.

Particulate, anionic, crosslinked organic polymers which are used according to the invention as component (iii) of the retention aid system can be prepared, for example, by polymerizing (a) from 10 to 100 mol % of at least one anionic monomer and (b) from 0 to 90 mol % of at least one nonionic monomer in the presence of (c) at least one crosslinking agent in an amount of, preferably, at least 7 ppm, in particular at least 15 ppm, based on the sum of (a) and (b).

The data in ppm are mol ppm.

Examples of monomers (a) are ethylenically unsaturated $C_3$- to $C_5$-carboxylic acids, ethylenically unsaturated sulfonic acids and/or salts of said acids. Individual examples of such monomers are acrylic acid, methacrylic acid, maleic acid, fumaric acid, crotonic acid, itaconic acid, 2-acrylamido-2-methylpropanesulfonic acid, styrenesulfonic acid, sulfopropyl acrylate, sulfopropyl methacrylate, vinylsulfonic acid and the alkali metal, alkaline earth metal and ammonium salts of said monomers. The sodium, potassium and/or ammonium salts of acrylic acid or methacrylic acid are preferably used.

Suitable monomers (b) are, for example, acrylamide, methacrylamide, acrylonitrile, methacrylonitrile, N-vinylformamide, N-isopropylacrylamide, N,N-dimethylacrylamide, N-vinylpyrrolidone, vinyl acetate, acrylates of monohydric alcohols having 1 to 6 carbon atoms, methacrylates of monohydric alcohols having 1 to 6 carbon atoms and styrene. The monomers which are insoluble or sparingly soluble in water are used in the polymerization only in amounts such that they also copolymerize with the water-soluble monomers, for example in amounts of less than 20 mol %, preferably less than 10 mol %.

At least one crosslinking agent is used as component (c) in the preparation of the particulate, anionic polymers. Crosslinking agents are to be understood as meaning compounds which comprise at least two ethylenically unsaturated double bonds in the molecule, e.g. methylenebisacrylamide, glycol diacrylate, glycol dimethacrylate, trimethylolpropane triacrylate, trimethylolpropane trimethacrylate, pentaerythrityl triacrylate, pentaerythrityl tetraacrylate, allyl acrylate, allyl methacrylate, triallylamine and butanediol diacrylate.

The amounts of crosslinking agent which are used in the polymerization are, for example, from 7 to 500 ppm, preferably from 15 to 200 ppm (calculated in moles in each case), based on the monomers used.

The particulate, anionic, crosslinked polymers are preferably prepared in the absence of a polymerization regulator. The polymerization can, however, also be carried out in the presence of a regulator, but in general larger amounts of crosslinking agents are then required in order to obtain suitable particulate anionic polymers. The crosslinked anionic polymer particles are preferably prepared by the reverse emulsion polymerization process. In this process, an aqueous monomer solution is emulsified in a hydrocarbon oil with the aid of at least one water-in-oil emulsifier and then polymerized. The polymer particles forming can be isolated from the W/O emulsion and obtained, for example, in the form of a powder. It is also possible to isolate the polymer particles from aqueous dispersions or from the water-in-water dispersions. Aqueous dispersions of the particulate, anionic, crosslinked polymers which have a polymer concentration of, for example, from 15 to 50% by weight are preferably used. In practice, N,N'-methylenebisacrylamide is preferably used as a crosslinking agent, in amounts of, for example, from 5 to 10,000, in particular from 15 to 1000, ppm by weight, for the preparation of the anionic, crosslinked polymer particles.

The anionic, crosslinked polymer particles have, for example, an intrinsic viscosity of less than 3 dl/g, for example in the range from 2 to 2.95 dl/g, determined according to ISO 1628/1, October 1988, "Guidelines for the standardization of methods for the determination of viscosity number and limiting viscosity number of polymers in dilute solution".

The particulate, anionic, crosslinked, organic polymer (iii) is used, for example, in an amount of from 30 to 1000 g/t, preferably from 30 to 600 g/t, of dry paper stock.

The retention aid system comprising the components (i), (ii) and (iii) can be used, for example, in such a way that first at least one compound of component (i) is metered into the high-consistency stock and the mixture is then diluted with water. However, the component (i) can also be metered into the low-consistency stock (solids content of, for example, from 0.7 to 1.5% by weight) and, if appropriate, then subjected to shearing, and the organic polymer of component (ii) and the component (iii) can then be added.

The organic polymers of components (ii) and (iii) can also advantageously be added in the form of a mixture to the low-consistency stock. If bentonite and/or silica gel are used as component (ii), the inorganic constituents of this component are metered before or after addition of the organic polymers of component (ii) or they are added simultaneously but separately. However, they can also be used alone as component (ii) of the retention aid system.

If two different polyvinylamines are used as component (i) for example, the component comprising vinylamine units and having a molar mass of from 45,000 to 350,000 is metered into the low-consistency stock itself (solids content>1.5% by weight), the pulp is diluted by addition of water, the other polymer comprising vinylamine units and belonging to component (i) is added, the mixture is then subjected to a shearing stage, the component (ii) and the component (iii) of the retention aid system are added and then the paper stock is drained. However, it is also possible to initially meter to the low-consistency stock the component (iii) and then the component (ii). However, it is also possible to adopt a procedure in which first the component (i) is added to the paper stock as described above, then the component (ii) is metered, the mixture is subjected to a shearing stage and then the component (iii) is added before the paper stock is drained. However, it is also possible to adopt a procedure in which, after the last shearing stage, first the component (i) and then the organic anionic polymer of component (ii) and the component (iii) and then the inorganic compounds of component (ii) are metered in succession before the headbox.

In a further process variant, an organic polymer and bentonite and/or silica gel are used as component (ii). Here, for example, it is possible to adopt a procedure in which first the inorganic compound of component (ii) is metered into the low-consistency stock before or after shearing and then the components (i) and (iii) and, if appropriate, the organic linear polymer of component (ii) are metered in any desired sequence. Further variants for the addition of the components of the retention aid system are possible. The most advantageous sequence of metering of the components (i), (ii) and (iii) depends in each case on the local circumstances.

The invention also relates to the use of a retention aid system comprising (i) at least one polymer comprising vinylamine units, in the form of the free bases, of the salts and/or in quaternized form, as the sole cationic polymer, (ii) at least one linear, anionic polymer having a molar mass $M_w$ of at least 1 million and/or at least one branched, anionic, water-soluble polymer and/or bentonite and/or silica gel, and (iii) at least one particulate, anionic, crosslinked, organic polymer having a mean particle diameter of at least 1 μm and an intrinsic viscosity of less than 3 dl/g as an additive in the production of paper, board and cardboard. The individual components can be added to the paper stock in any desired sequence, it being possible for the constituents of component (ii) to be metered individually or as a mixture and it being possible for the components (ii) and (iii) to be added separately or as a mixture to the paper stock.

Surprisingly, considerably improved retention is obtained by the process according to the invention in comparison with the use of cationic polyacrylamides in combination with an anionic polymer and a particulate, crosslinked anionic polymer having a particle size below 1 μm. The exclusive use of polymers comprising vinylamine units as a constituent of the retention aid system leads to an improvement in the drainage properties in comparison with the cationic polyacrylamides usually used in retention aid systems.

All paper stocks can be processed by the process according to the invention. For example, it is possible to start from cellulose fibers of all types, both from natural and from recovered fibers, in particular from fibers from wastepaper. Suitable fibers for the production of the pulps are all qualities customary for this purpose, e.g. mechanical pulp, bleached and unbleached chemical pulp and paper stocks comprising all annual plants. Mechanical pulp includes, for example, groundwood, thermomechanical pulp (TMP), chemothermomechanical pulp (CTMP), pressure groundwood, semichemical pulp, high yield chemical pulp and refiner mechanical pulp (RMP). Sulfate, sulfite and soda pulps are suitable, for example, as chemical pulp. Unbleached chemical pulp, which is also referred to as unbleached kraft pulp, is preferably used. Suitable annual plants for the production of paper stocks are, for example, rice, wheat, sugarcane and kenaf. The pulps can also advantageously be produced using wastepaper, which is used either alone or as a mixture with other fibers, or fiber mixtures comprising a primary stock and recycled coated broke are used as starting material, for example bleached pine sulfate mixed with recycled coated broke.

The retention aid system (i), (ii) and (iii) can be used together with the conventional process chemicals in the production of paper and paper products. Conventional process chemicals are, for example, additives, such as starch, pigments, optical brighteners, dyes, biocides, strength agents for paper, sizers, fixing agents and antifoams. Such additives are used in the otherwise usual amounts. For example, all starch types, such as natural starches or modified starches, in particular cationically modified starches, can be used as starch. Suitable fixing agents are, for example, polydimethyldiallylammonium chloride, dicyandiamide resins, epichlorohydrin-crosslinked condensates of a dicarboxylic acid and a polyamine, polyaluminum chloride, aluminum sulfate and polyaluminum chlorosulfate. Suitable sizers are, for example, rosin size, alkyldiketenes or alkenylsuccinic anhydrides.

EXAMPLES

The following starting materials were used in the examples and comparative examples:

PVAm 1: polyvinylamine having a molar mass $M_w$ of 45,000 D (prepared by hydrolysis of poly-N-vinylformamide, degree of hydrolysis of 95 mol %, i.e. the polymer also comprises vinylformamide units in addition to vinylamine units)

PVAm 2: polymer comprising 20 mol % of vinylamine units and 80 mol % of N-vinyl-formamide units, having a molar mass $M_w$ of 1.5 million D (prepared by hydrolysis of poly-N-vinylformamide, degree of hydrolysis 20 mol %)

Lin.PAM/PAS: Mixture of (a) 90% by weight of a linear polymer of 70 mol % acrylamide and 30 mol % of sodium acrylate, $M_w$ 5 million (organic polymer of retention aid component (ii)) and (b) 10% by weight of a particulate, anionic, crosslinked copolymer of 30 mol % of acrylamide and 70 mol % of ammonium acrylate, mean particle size 1.2 μm, intrinsic viscosity 2.5 dl/g (retention aid component (iii)), prepared by inverse emulsion polymerization.

Mikrofloc® XFB: Bentonite

PAM: copolymer of acrylamide and dimethylaminoethyl acrylate, quaternized with methyl chloride, cationicity 15 mol %, molar mass $M_w$ 5 million The intrinsic viscosity was determined according to ISO 1628/1, October 1988, "Guidelines for the standardization of methods for the determination of viscosity number and limiting viscosity number of polymers in dilute solution". The molar masses of the polymers were determined by light scattering.

Examples 1 to 5 and Comparative Examples 1 to 8

The retention effect (total retention FPR and ash retention FPAR) was determined according to Britt Jar. A paper stock comprising 70% by weight of TMP (thermomechanical pulp), 30% by weight of bleached pine sulfate and 30% by weight of ground calcium carbonate was used for all examples. The paper stock was diluted to a solids content of 0.77% by weight, and in each case the components of the retention aid system which are mentioned in Table 1 were added, the following sequence being maintained: if appropriate, PVAm 1, PVAm2 or PAM (Comparative Examples), Lin-.PAM/PAS and, if appropriate, bentonite. If bentonite was used, bentonite and Lin.PAM/PAS were metered simultaneously. The retention values are shown in Table 1.

The drainage time was determined in a Schopper-Riegler tester by draining therein in each case 1 l of the fiber suspension to be tested and determining the time which was necessary for the passage of 600 ml of filtrate. The results are shown in Table 1.

In addition, sheets having a basis weight of 80 g/m$^3$ were formed in a standard laboratory sheet former from the paper stock described above, and the formation of the sheets was determined with the aid of a 2 D laboratory formation sensor from Techpap. The lower the measured value, the better is the formation of the sheets.

TABLE 1

| | Retention aid [kg/t] | Lin. PAM/PAS [kg/t] | Bentonite [kg/t] | FPR [%] | FPAR [%] | Drainage time [sec] | Formation |
|---|---|---|---|---|---|---|---|
| Example No. | | | | | | | |
| 1 | 0.4 PVAm 2 | 0.3 | | 95 | 91 | 31 | 162 |
| 2 | 0.4 PVAm 1 | 0.3 | | 95 | 92 | 31 | 165 |
| 3 | 0.2 PVAm 1<br>0.2 PVAm 2 | 0.3 | | 96 | 96 | 26 | 170 |
| 4 | 0.4 PVAm 2 | 0.15 | 1.0 | 96 | 96 | 24 | 169 |
| 5 | 0.4 PVAm 2 | 0.15 | 1.0 | 94 | 89 | 34 | 165 |
| Comparative Example No. | | | | | | | |
| 1 | 0.4 PVAm 2 | | | 83 | 62 | 52 | 151 |
| 2 | 0.4 PVAm 1 | | | 77 | 43 | 73 | 143 |
| 3 | 0.4 PAM | | | 85 | 68 | 52 | 156 |
| 4 | 0.4 PAM | 0.3 | | 93 | 87 | 60 | 159 |
| 5 | 0.2 PVAm 1<br>0.2 PAM | | | 84 | 69 | 38 | 154 |
| 6 | 0.2 PVAm 1<br>0.2 PVAm 2 | | | 83 | 64 | 49 | 152 |
| 7 | 0.4 PAM | 0.15 | 1.0 | 96 | 96 | 38 | |
| 8 | — | — | — | 66 | 5 | 102 | 120 |

We claim:

1. A process for the production of paper, board and cardboard by draining a paper stock with sheet formation in the presence of a retention aid system comprising at least one polymer comprising vinylamine units and at least one particulate, anionic, crosslinked, organic polymer, wherein said retention aid system comprises (i) at least one polymer comprising vinylamine units, in the form of the free bases, of the salts and/or in quaternized form, as the sole cationic polymer, (ii) at least one linear, anionic polymer having a molar mass $M_w$ of at least 1 million and/or at least one branched, anionic, water-soluble polymer and/or bentonite and/or silica gel, and (iii) at least one particulate, anionic, crosslinked, organic polymer having a mean particle diameter of at least 1 μm and an intrinsic viscosity of less than 3 dl/g.

2. The process according to claim 1, wherein the components (ii) and (iii) of the retention aid system are metered separately or as a mixture to the paper stock.

3. The process according to claim 1, wherein the retention aid system comprises (i) at least one polymer comprising vinylamine units, in the form of the free bases or of the salts, which is obtainable by hydrolysis of polymers comprising vinylformamide units, the degree of hydrolysis being from 0.5 to 100 mol %, (ii) at least one linear, anionic polymer having a molar mass of at least 2 million, obtained from (a) acrylamide and/or methacrylamide and (b) acrylic acid, methacrylic acid, maleic anhydride, maleic acid, itaconic acid, crotonic acid, 2-acrylamido-2-methylpropanesulfonic acid, vinylsulfonic acid and/or salts of said acids and/or bentonite and/or silica gel and (iii) at least one particulate, anionic, crosslinked organic polymer which comprises, incorporated in the form of polymerized units, at least one ethylenically unsaturated $C_3$- to $C_5$-carboxylic acid, an ethylenically unsaturated sulfonic acid or a salt of said acids and in each case at least one crosslinking agent and which can be prepared by inverse emulsion polymerization.

4. The process according to claim 1, wherein the retention aid comprises, as component (i), a polymer comprising vinylamine units and having a molar mass $M_w$ of from 10,000 to 500,000 and a polymer comprising vinylamine units and having a molar mass of at least 1 million.

5. The process according to claim 1, wherein the polymer comprising vinylamine units (i) is used in an amount of from 0.003 to 0.3% by weight, based on dry paper stock.

6. The process according to claim 1, wherein the linear, anionic polymer and/or the branched, anionic, water-soluble polymer of component (ii) are used in an amount of from 0.003 to 0.3% by weight, based on dry paper stock.

7. The process according to claim 1, wherein the particulate, anionic, crosslinked, organic polymer (iii) is used in an amount of from 30 to 1000 g/t of dry paper stock.

8. The process according to claim 1, wherein bentonite and/or silica gel of component (ii) are used in an amount of from 0.01 to 1.0% by weight, based on dry paper stock.

9. An additive in the production of paper, board and cardboard comprising a retention aid system comprising (i) at least one polymer comprising vinylamine units, in the form of the free bases, of the salts and/or in quaternized form, as the sole cationic polymer, (ii) at least one linear, anionic polymer having a molar mass $M_w$ of at least 1 million and/or at least one branched, anionic, water-soluble polymer and/or bentonite and/or silica gel, and (iii) at least one particulate, anionic, crosslinked, organic polymer having a mean particle diameter of at least 1 μm and an intrinsic viscosity of less than 3 dl/g.

* * * * *